US009216599B2

(12) United States Patent
Orue et al.

(10) Patent No.: US 9,216,599 B2
(45) Date of Patent: Dec. 22, 2015

(54) PRINT MEDIA STACKER

(71) Applicant: Hewlett-Packard Development Company, LP., Houston, TX (US)

(72) Inventors: Eduardo Martin Orue, Sant Cugat del Valles (ES); Joseba Ormaechea Saracibar, Sant Cugat del Valles (ES); Fernando Juan Jover, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 146 days.

(21) Appl. No.: 13/764,361

(22) Filed: Feb. 11, 2013

(65) Prior Publication Data

US 2014/0225967 A1 Aug. 14, 2014

(51) Int. Cl.

| | |
|---|---|
| ***B41J 2/01*** | (2006.01) |
| ***B41J 13/10*** | (2006.01) |
| ***B41J 11/00*** | (2006.01) |
| ***B65H 31/02*** | (2006.01) |

(52) U.S. Cl.

CPC ..... *B41J 13/106* (2013.01); *B41J 11/001* (2013.01); *B41J 13/10* (2013.01); *B65H 31/02* (2013.01); *B65H 2301/341* (2013.01); *B65H 2301/42142* (2013.01); *B65H 2404/1521* (2013.01); *B65H 2404/691* (2013.01); *B65H 2404/6942* (2013.01); *B65H 2701/11312* (2013.01)

(58) Field of Classification Search

CPC ..... B41J 13/106; B41J 13/10
USPC ..... 347/104, 101; 271/207, 209, 213, 220, 271/3.14

See application file for complete search history.

(56) References Cited

U.S. PATENT DOCUMENTS

| | | | | |
|---|---|---|---|---|
| 5,215,301 | A | 6/1993 | Oshino et al. | |
| 5,732,315 | A | 3/1998 | Inoue et al. | |
| 5,764,264 | A * | 6/1998 | Takanaka | 347/104 |
| 6,042,109 | A | 3/2000 | Klausbruckner | |
| 7,584,959 | B2 | 9/2009 | Kinoshita et al. | |
| 8,146,904 | B2 | 4/2012 | Watanabe et al. | |

OTHER PUBLICATIONS

Ricoh Production Print Soluitions, "Using the Printer Stacker with a Postprocessing Device," http://www4.infoprintsolutionscompany.com/help/index.jsp?topic=%2Fcom.ibm.printers.ip3000operatorsguide%2Fhc6o4mst112.htm, 1 page (Last Accessed Feb. 11, 2013).

Lanier, "MP W5100, MP W7140: Fast Wide-Format Multifunctionals for Peak Performance," Lanier Specification Guide, 8 pages (Last Accessed Feb. 11, 2013).

* cited by examiner

*Primary Examiner* — Henok Legesse

(57) ABSTRACT

Print media stacker comprising a ramp to curve printed media over an angle of between 20 and 90 degrees with respect to a media advance direction.

17 Claims, 8 Drawing Sheets

PRINT MEDIA STACKER

BACKGROUND

Large format media can be stacked after printing. Different systems or processes are used to stack printed media. Sometimes operators manually pick up media from a printer and stack the media at a distance from the printer. Separate dedicated media stackers are known that can be placed behind the printer for automatically stacking incoming printed media after printing. Printers with integrated stackers are known that stack media on a tray in the printer. Some printers have a basket for catching printed media after printing.

BRIEF DESCRIPTION OF THE DRAWINGS

For the purpose of illustration, certain examples constructed in accordance with the teachings of this disclosure will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements.

Figure 1:
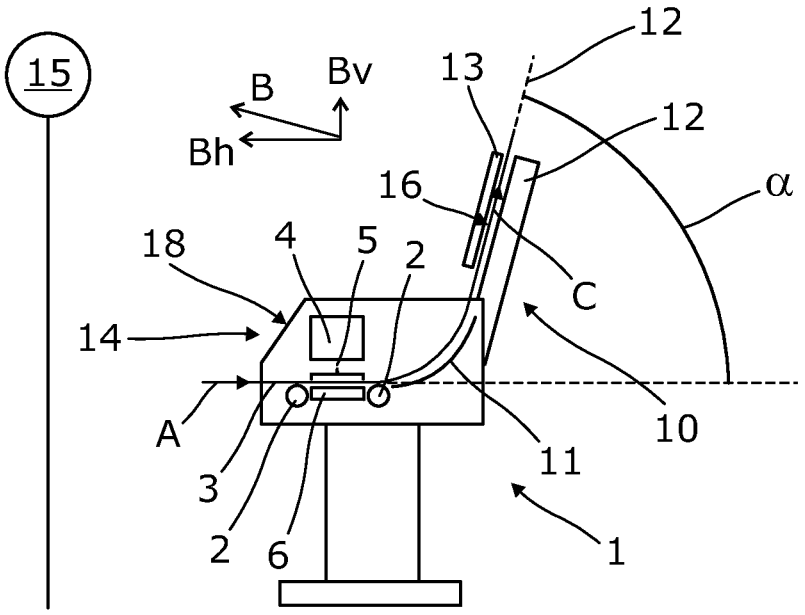
FIG. 1 illustrates a diagram of an example of a printer and an operator.

FIG. 1 illustrates a diagrammatic side view of a large format printer 1. The printer 1 includes a media advance system 2, for advancing large format media 3 in a first direction A, under a printhead 4, for printing. The first direction A can be horizontal. In the drawing the media advance system is schematically illustrated by two drive wheels 2. In other examples the media advance system includes a transmission, gears and pinch wheels. The printhead 4 can be a scanning printhead or a page wide array of printheads, each printhead including ink ejection nozzle arrays. For example the printer 1 is to print on large format media 3 having a width of at least approximately 59 centimeters, for example at least A1 format. It is to be understood that a "width" of the media 3 would extend perpendicular into the drawing of FIG. 1, and is therefore not illustrated. The printer 1 includes a print zone 5, which can be defined as the zone wherein the printhead 4 is to transfer ink. The print zone 5 may be defined by a swath of a scanning printhead, or by dimensions of a page wide array of printheads. For example the printhead 4 covers a print zone 5 having a longest dimension of at least approximately 59 centimeters. For example the length of the print zone 5 corresponds to a maximum media width. The printer 1 includes a print platen 6, arranged in or near the print zone 5, under the printhead 4, for supporting the media during printing. For example, the media 3 is advanced in a horizontal direction A in the print zone 5, over the print platen 6.

The printer 1 includes a stacker 10 for stacking printed large format media 3. In the illustrated example the stacker 10 is fixed to the printer 1, allowing inline stacking of the media 3 during printing. The stacker 10 is arranged downstream of the printhead 4. The media advance system 2 advances the media 3 to the stacker 10.

The stacker 10 includes a ramp 11 to curve printed media 3. The stacker 10 includes an inclined stacker support 12 to receive the media 3 from the ramp 11 and stack the media 3. The ramp 11 is arranged at the bottom of the support 12. The support 12 is to support the backside of the media 2. The stacker 10 further includes a top guide 13, positioned opposite to the support 12, to guide the large format media 3 on the image side of the media 3. For example the top guide 13 is to engage the image side of the media 3 without smearing the printed image, even when the printed image is not fully dried. For example, the stacker 10 has a width of at least 59 centimeters, and correspondingly the support 12 and top guide 13 have width of at least 59 centimeters, corresponding to the maximum media width and print zone length.

For example the ramp 11 receives incoming printed media 3 and guides the printed media 3 to the stacker support 12. The ramp 11 is to curve the printed media 3 over an angle $\alpha$ of between approximately 20 and approximately 90 degrees with respect to the first direction A, or for example between approximately 20 and approximately 85 degrees. In the illustrated example the ramp 11 is to curve the media 3 over an angle $\alpha$ of approximately 70 to 80 degrees, for example close to 75 degrees. Correspondingly the support 12 allows for supporting and advancing the stacked media under said angle $\alpha$ of between approximately 20 and approximately 90 degrees, or for example between approximately 20 and approximately 85 degrees, for example between approximately 70 and approximately 80 degrees, or for example close to 75 degrees.

For example, by stacking the printed media 3 having an inclination a with respect to the media advance direction or horizontal A of approximately 20 to 90 degrees, a printed image 16 on stacked media 3 conveniently faces an operator 15, allowing the operator 15 to view the printed image 16 during printing, as it advances over the support 12. For example, the printed image 16 faces towards the front side 14 of the printer 1, as illustrated by a horizontal component Bh of the image facing direction B. For example the image also faces upwards, as illustrated by a vertical component Bv of the image facing direction B. For example the front side 14 of the printer 1 can be defined as the side of the printer 1 where an operator panel 18 is located, or where a media input of the printer 1 is located.

The top guide 13 is to guide the media 3 along its printed top surface 16 while it advances over the stacker 10. For example, the top guide 13 is to prevent buckling or curling of the media 3 while it advances over the previously stacked media 3 on the support 12. For example relatively thin large format media that is wet after printing may tend to buckle or curve when advancing over the support 12, in an upwards direction C, or for example thick large format media can tend to bend or buckle under its own weight. For example, the printer 1 allows for relatively thin and flexible media and can allow installation of a 2 inch media roll. The top guide 13 can guide and flatten the media 3 while it advances in the stacker 10 and prevent bending, buckling, curving, or other deformations.

Figure 2:
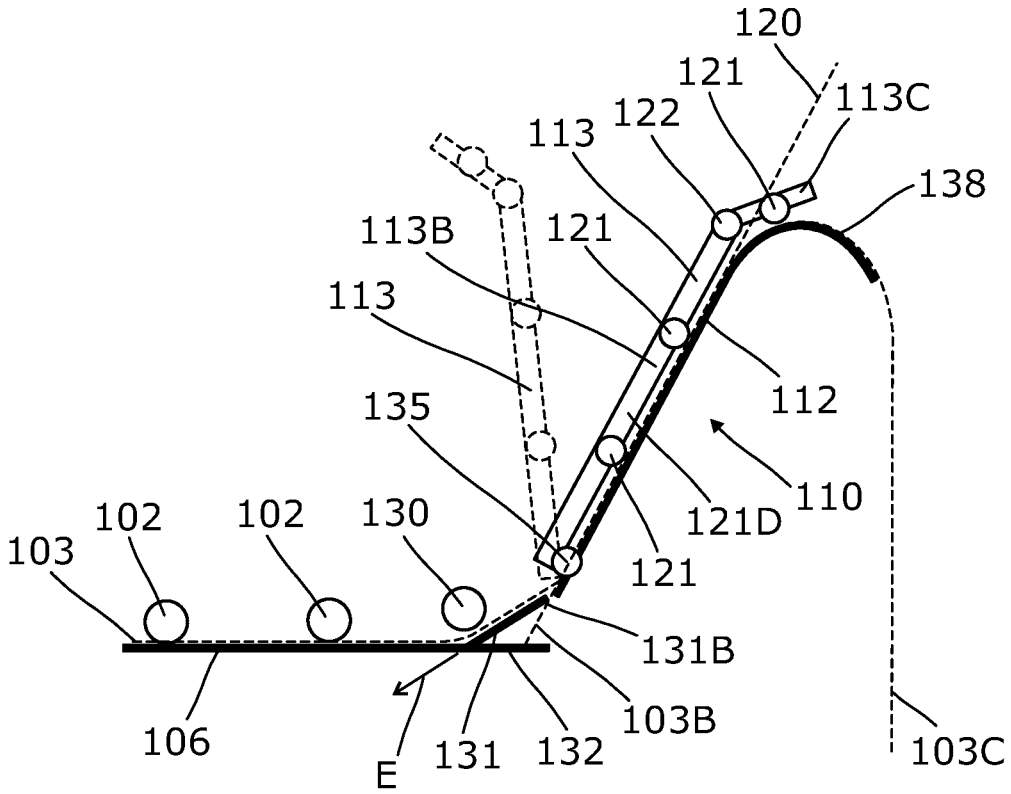
FIG. 2 illustrates a diagram of an example of a part of a printer including a stacker.

FIG. 2 illustrates another example of a printer, showing only a portion of the printer including a platen 106, media advance system 102 and a stacker 110. The media advance system 102 is schematically illustrated by two guide wheels 102. The printer includes a stacker input drive 130 to advance media 103 into the stacker 110, the stacker input drive 130 schematically illustrated by a wheel.

The printer includes a bridge 131. For example the bridge 131 is retractable. For example in the extended position an extreme 131B of the bridge 131 retains the media stack near its foot 103B of the media stack. In the extended position, the bridge 131 is to guide the media 103 during printing over a foot 103B of the media stack. For example, the bridge 131 guides the media 103 into the stacker 110 without interference with the bottom edges of the pre-stacked media.

For example the bridge 131 is retractable in a direction E away from the stacker support 112. For example the bridge 131 is to be retracted after a trailing edge of the advancing printed media 103 has passed the bridge 131, or at the moment the trailing media edge is about to pass the bridge 131. As the bridge 131 retracts, the printed media 103 slides downwards, until it rests onto a media stack foot support 132 of the stacker 110. The stack foot support 132 is arranged under the bridge 131, at least in an extended position of the bridge 131. For example the stack foot support 132 includes a tray or gutter for supporting stacked media at the foot 103B.

For example the stacker support 112 for advancing and supporting a back of the media 3 includes a curved upper portion 138, for curving the media 103 downwards over the top of the stacker 110 so that part 103C of the media stack hangs down over the stacker 103, while reducing the risk of folding or buckling.

The printer includes a top guide 113. In FIG. 2 the top guide 113 is illustrated in a closed position 113 by normal lines and in an open position by ghost lines. For example the top guide 113 includes a first hinge 135 to hinge the top guide 113 with respect to the support 112. The first hinge 135 allows the top guide 113 to be opened with respect to the support 112, facilitating convenient release of the media stack from the stacker 110 when the top guide 113 is in open position.

For example, the top guide 113 includes top guide elements 121 arranged to engage media 103 in a single plane 120, parallel to a support surface of the support 112. For example the top guide elements 121 aid in maintaining a relatively flat shape of the media 103 advancing over the support 112, preventing buckling, curving, etc. For example the top guide elements 121 engage the printed image side of the media 103. For example, the top guide elements 121 are regularly distributed over the support plane, for example for optimal guidance and flattening of the media 103. For example, the top guide elements 121 comprise passive wheels. For example, the top guide elements 121 include star wheels or rubber wheels to avoid marks on printed media that is not fully dry.

For example the top guide 113 includes a top guide base portion 113B and an upper top guide portion 113C. For example the top guide 113 includes a second hinge 122 for hinging the upper top guide portion 113C with respect to the top guide base portion 113B. For example the second hinge 122 is arranged near the curved upper portion 138 of the support 112, that is, in a closed position of the top guide 113, to allow the top guide 113 to adapt to the shape of the support 112 near the curved upper portion 138. For example the upper top guide portion 113C hinges towards the support 112 over the second hinge 122 to engage the media on the curved upper portion 138. For example the second hinge 122 also allows for hinging the upper top guide portion 113C away from the support 112 to take out media from the stacker 110 without needing to open the entire top guide 113 about the first hinge 135.

Figure 3:
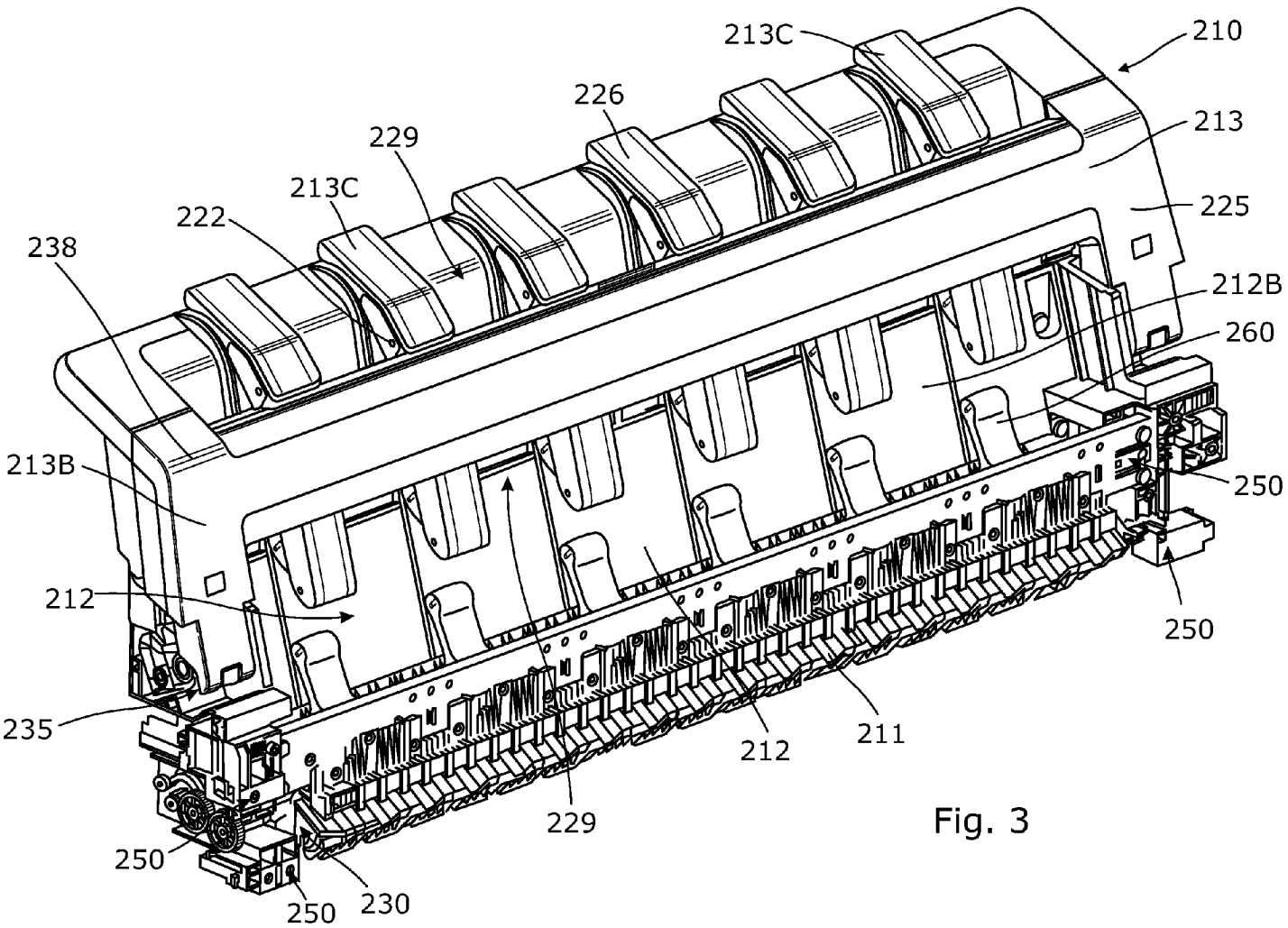
FIG. 3 illustrates an example of a closed stacker in perspective view.

FIG. 3 shows an example of a stacker 210 dismounted from a printer. For example the stacker 210 is a subassembly to be mounted to the printer during manufacture, or an accessory to be acquired separately. For example, the illustrated stacker 210 includes mount surfaces 250 to mount the stacker 210 to a printer, the mount surfaces 250 including at least one of threads, notches, holes and projections to facilitate mounting. The stacker 210 is at least 59 centimeters wide for stacking large format media, and in mounted condition extends along the width of the printer.

FIG. 3 show an example of a stacker 210 in a condition wherein the top guide 213 is closed. The top guide 213 defines openings 229 to allow viewing of the printed image while the media advances through the stacker 210.

The stacker 210 includes a first ramp 211 for receiving and curving incoming media while it is printed. For example a media advance system of the printer advances the media up the first ramp 211 during printing. The stacker 210 includes a stacker drive 230 downstream of the foot of the first ramp 211 for driving the incoming media into the stacker 210. The stacker 210 includes a support 212 and a top guide 213 arranged over the support 212. The support 212 includes a curved upper portion 238. The top guide 213 includes a top guide base portion 213B and upper top guide portions 213C. In engaged condition, the top guide base portion 213B extends along a base portion 212B of the support 212 and the upper top guide portion 213C extends along the curved upper portion 238 of the support 212. For example the base portion 212B of the support 212 is to support and maintain a flat portion of the media stack in the support 212.

The stacker 210 includes a first hinge 235 that connects the top guide 213 to the support 212 for hinging the top guide 213 with respect to the support 212. The stacker 210 includes second hinges 222 that connect the upper top guide portions 213C to the top guide base portion 213B for hinging the upper top guide portions 213C with respect to the top guide base portion 213B. For example the second hinges 222 are to hinge the upper top guide portions 213C towards the curved upper portion 238 of the support 212, as illustrated in FIG. 3. For example the second hinge 222 also allows for hinging the upper top guide portion 213C away from the support 212 to take out media from the stacker 210 without hinging the top guide base portion 213B over the first hinge 235. For example, the top guide 213 includes a frame consisting of cover plates 225, 226. For example, the cover plates 225, 226 can serve to protect guide elements 221, hinges and/or other stacker drive or transmission mechanisms.

In an example, at least one hingeable second top guide 260 is provided, upstream of the first top guide 213 and downstream of the first ramp 211 and stacker drive 230, to provide additional top guidance while the media advances over the support 212 towards the first top guide 213.

Figure 4:
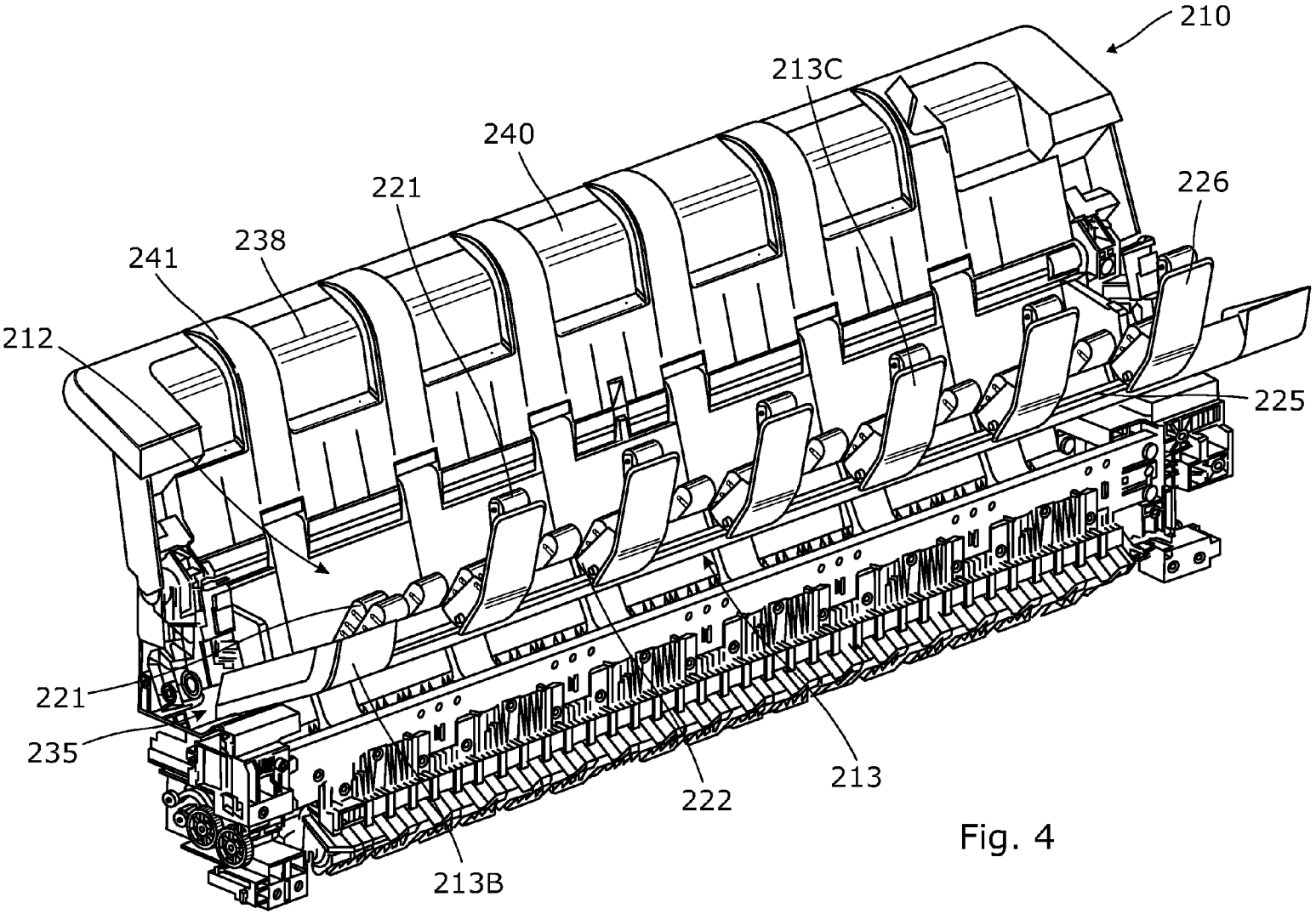
FIG. 4 illustrates an example of an opened stacker in perspective view.

In FIG. 4 the top guide 213 is opened, by being hinged over the first hinge 235. The upper top guide portions 213C are hinged away from the support 212, over the second hinges 222. As can be seen from FIG. 4, the curved upper portion 238 of the support 212 can include regularly distributed cut outs 240 and elevated guides 241 over the width of the curved upper portion 238. For example, the cut outs 240 serve to reduce a likelihood of media deflecting against the support surface and/or to facilitate insertion of fingers below the media to take the media out of the stacker. For example the elevated guides 241 serve to engage and guide the media over the curved upper portion 238. For example the positions of the elevated guides 241 correspond to the positions of the upper top guide portions 213C, so that the elevated guides 241 and the guide wheels 221 of the upper top guide portions 213C have corresponding positions opposite to each other for guiding and curving the media, and engage in a closed condition of the top guide 213 when there is no media stacked.

Figure 5:
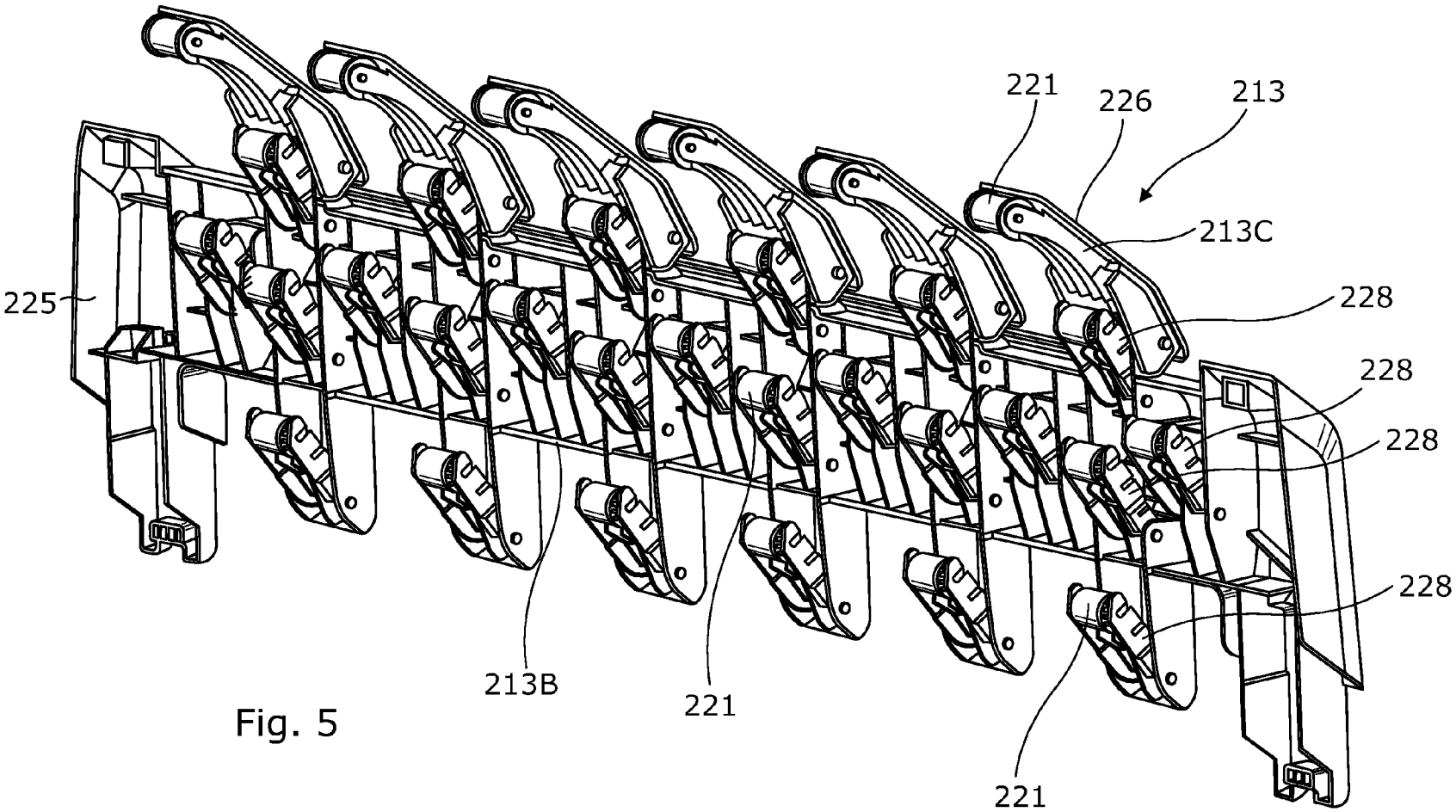
FIG. 5 illustrates an example of a top guide in perspective view.

FIG. 5 illustrates an example of a top guide 213 dismounted from the support 212. A view on the bottom of the top guide 213 illustrates regularly distributed guide elements, defined by passive guide wheels 221. The passive wheels 221 are regularly distributed in a single plane and rotate freely so as to guide the media while maintaining the flat media surface and with relatively low friction between the wheels 221 and the media. The top guide 213, or the top guide base portion 213B taken alone, can include multiple rows and multiple columns of guide wheels 221 distributed over the surface of the top guide 213 or top guide base portion 213B, respectively. Also the upper top guide portion 213C includes multiple guide wheels 221, for example in a single row or in multiple rows. The top guide base portion 213B includes guide wheel arms 228 to which the guide wheels 221 are rotatably mounted. For example the guide wheel arms 228 are moveable or hingeable to adapt to different media thicknesses and media stack thicknesses. For example the guide wheel arms 228 are connected to a base cover plate 225 in a fixed, hingeable or translatable manner. For example a leaf or spiraled spring or other resilient mechanism provides for a suitable counterforce against hinging to maintain the guide wheels 221 against the media.

Figure 6:
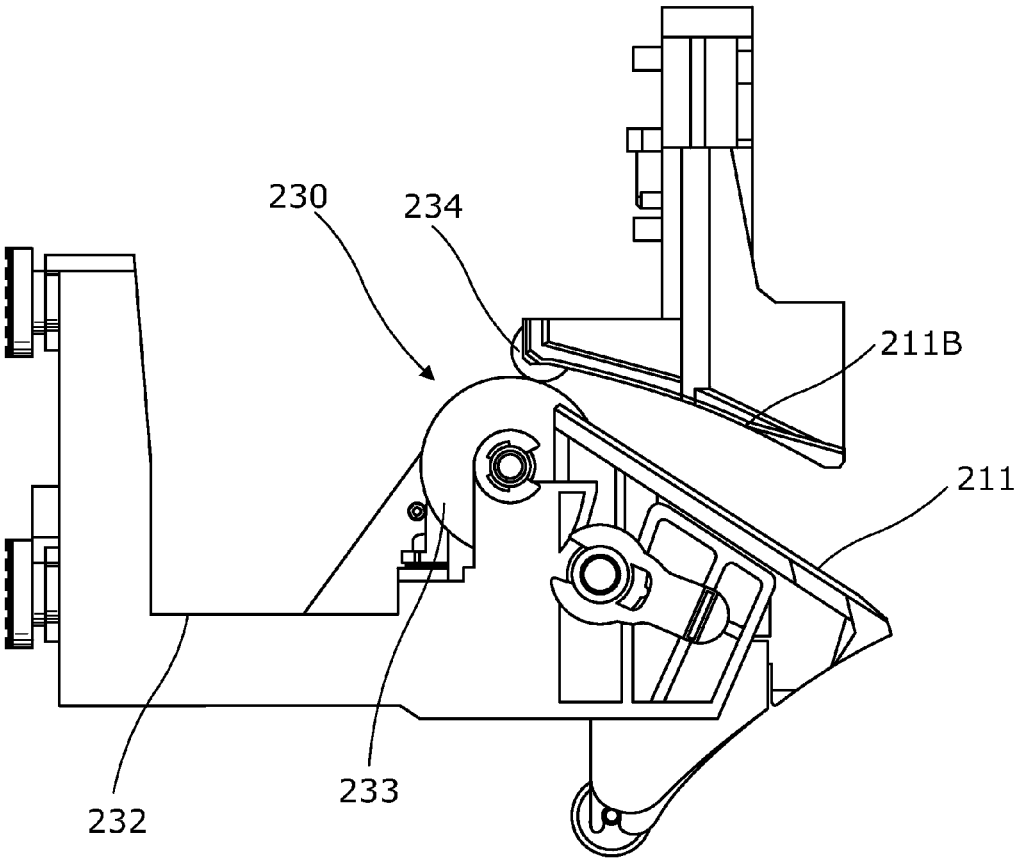
FIG. 6 illustrates an example of a stacker drive in side view.

FIG. 6 illustrates an example of a stacker drive 230. For example the stacker drive 230 is arranged at the foot of the stacker 210, for example downstream of the first ramp 211. For example the stacker drive 230 includes opposite pinch wheels 233, 234 at least one of which is actively driven by a motor (not shown). For example the stacker drive 230 includes a servo motor that is instructed by a printer controller of the printer.

For example the first ramp 211 receives incoming media from the media advance system (not shown) while being printed, and guides the media towards the stacker drive 230. For example the stacker drive 230 is the only drive for advancing the media in the stacker 210 when the trailing end of the media has passed the media advance system. For example the stacker 210 includes a ramp roof 211B opposite to the first ramp 211 to aid in guiding the media to the pinch wheels 233, 234. For example, the stacker drive 230 and the first ramp 211, 211B have fixed positions with respect to the support 212. For example multiple pinch wheel pairs 233, 234 are distributed over the width of the stacker 210.

Figure 7:
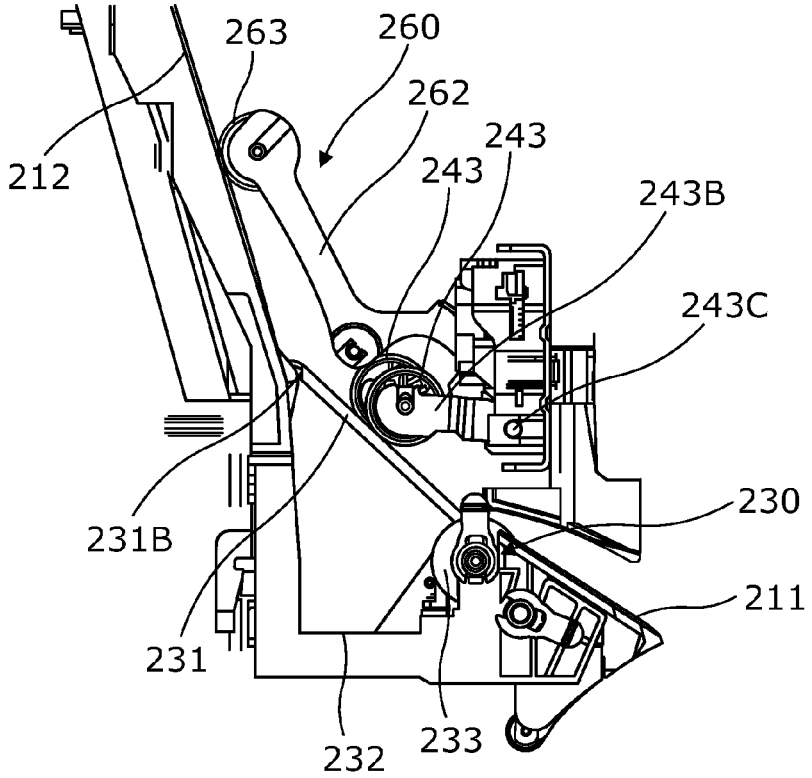
FIG. 7 illustrates an example of a portion of a stacker in side view, with a bridge and wheel in extended position.

FIG. 7 illustrates a media release system that includes a retractable bridge 231 and a retractable pinch wheel 243 in extended condition, in a side view. For example multiple retractable bridges 231 and multiple pinch wheel pairs 243 are distributed over the width of the stacker 210. For example the bridge 231 is arranged downstream of the stacker drive 230 and the first ramp 211, and upstream of the support 212. For example the first ramp 211 and the bridge 231 together form a ramp for curving and guiding the media towards the support 212, in extended condition of the bridge 231. For example, the bridge 231 spans between the first ramp 211 and the support 212. In the extended condition the bridge 231 extends over a stack foot support 232. For example, the stack foot support 232 includes a tray for supporting the foot of the media stack and is arranged below the bridge 231. In use, in the extended condition, an extreme 231B of the bridge 231 engages and retains the media stack while media being printed is guided over the bridge 231 and over the foot of the media stack. In example the bridge 231 is arranged to extend over a desired distance depending on a media stack distance. For example the bridge 131 is arranged to engage both thin and thick media stacks. For example the retractable bridge is to have an adjustable gap between its extreme 231B and 212.

For example the retractable pinch wheels 243 are rotatably mounted to a retractable pinch wheel arm 243B. For example the pinch wheel arm 243 is pivotably mounted about a third hinge 243C, to be pivoted between an extended position (FIG. 7) and a retracted position (FIG. 8) with respect to the support 212. For example the third hinge 243C is arranged so that there is margin for the pinch wheel arm 243B to move upwards to allow pinching of multiple media thicknesses with respect to the bridge 231, while the arm 234B is free to pivot downwards when the bridge 231 retracts.

For example, the second top guide 260 is to guide and flatten the media before it is further guided and flattened by the first top guide 213. For example the second top guide 260 is arranged downstream of the stacker drive 230, downstream of the bridge 231 and upstream of the top guide 213, along the support 212. The second top guide 260 includes a fourth hinge (not shown), a pivoting arm 262 that allows for pivoting of the arm over the fourth hinge with respect to the support 212, and at least one passive guide wheel 263 rotatably mounted onto the pivoting arm 262.

Figure 8:
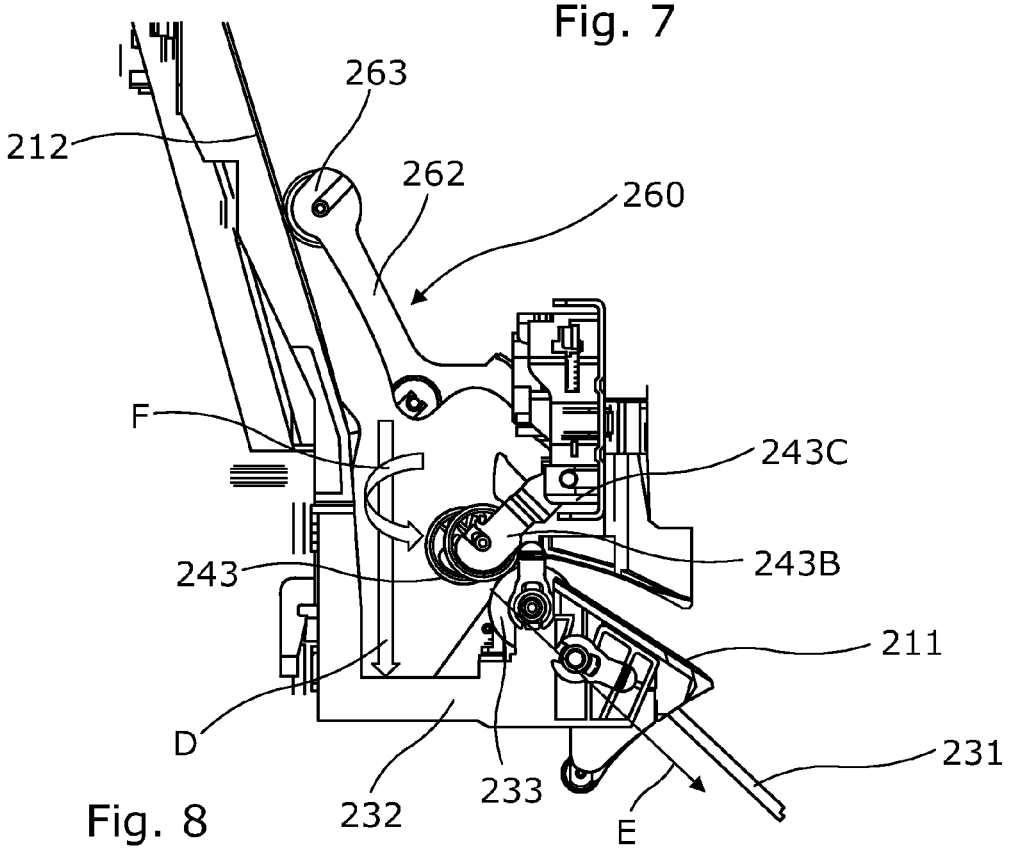
FIG. 8 illustrates the example portion of the stacker of FIG. 7 in side view with the bridge and wheel in retracted position.

FIG. 8 illustrates the same example assembly as FIG. 7, but in a retracted condition of the bridge 231 and pinch wheels 243. The bridge 231 is to retract in a direction E to a position behind the stack drive pinch wheels 233, 234. By retracting the bridge 231, the trailing end of the media is released from the stacker drive pinch wheels 233, 234, so that the media slides by force of gravity in a direction D downwards until the bottom media edge lands on the stack foot support 232. For example, extension and retraction of the bridge 231 is actuated by the stacker drive 230 or another motor or servo system. For example an independent motor or servo system is disposed near the bridge 231 to extend and retract the bridge 231, for example to allow continuous media advancement by the stacker drive 230 and separately driven extension and retraction of the bridge 231.

As illustrated in FIG. 8 in an example the retractable pinch wheels 243 retract in a direction F downwards by retraction of the bridge 231, for example induced by the retraction of the bridge 231. For example herein retraction includes hinging the pinch wheels 243 downwards about the third hinge 243C. As the pinch wheels 243 hinge downwards they guide the foot of the released media in the direction D towards the stack foot support 232, therewith aiding in proper stacking of the media.

After said media release, the pinch wheels 243 are moved back to the extended position by the bridge 231 that moves from the retracted towards the initial extended position, for example actuated by the stacker drive 230 or a separate servo system. For example during extension of the bridge 231, the extreme 231B pushes the retracted pinch wheel 243 upwards. The pinch wheel 243 hinges upwards until both the bridge 231 and pinch wheels 243 are in the initial extended position (FIG. 7) for advancing the media being printed over the recently stacked media.

For example, the action of retracting the bridge 231 and pinch wheels 243 and extending back again can occur rapidly to allow media stacking to occur continuously substantially without interrupting the print process. For example within the printer a media roll can be printed, cut and stacked in-line and continuously.

Figure 9:
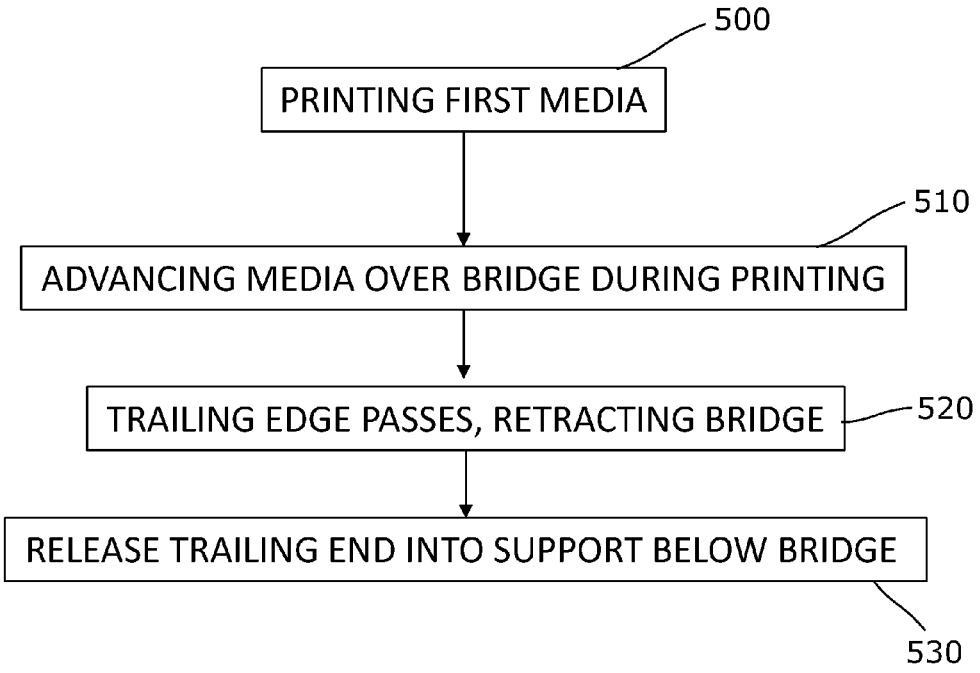
FIG. 9 illustrates a flow chart of an example method of printing.

FIG. 9 illustrates a flow chart of an example of a method of printing large format media 3, 103. For example the method includes printing first media 3, 103 (block 500). For example the method includes, during said printing, advancing the first media 3, 103 over a bridge 131, 231 into a stacker 10, 110, 210 (block 510). For example the method includes retracting the bridge 131, 231 when a trailing edge of the media 3, 103 has passed (block 520). For example the method includes releasing a foot 103B of the first media 3, 103 into a stack foot support 132, 232 below the bridge 131, 231 (block 530). Herein the foot 103B is to be understood as the portion of the media 3, 103 that is trailing during printing.

Figure 10:
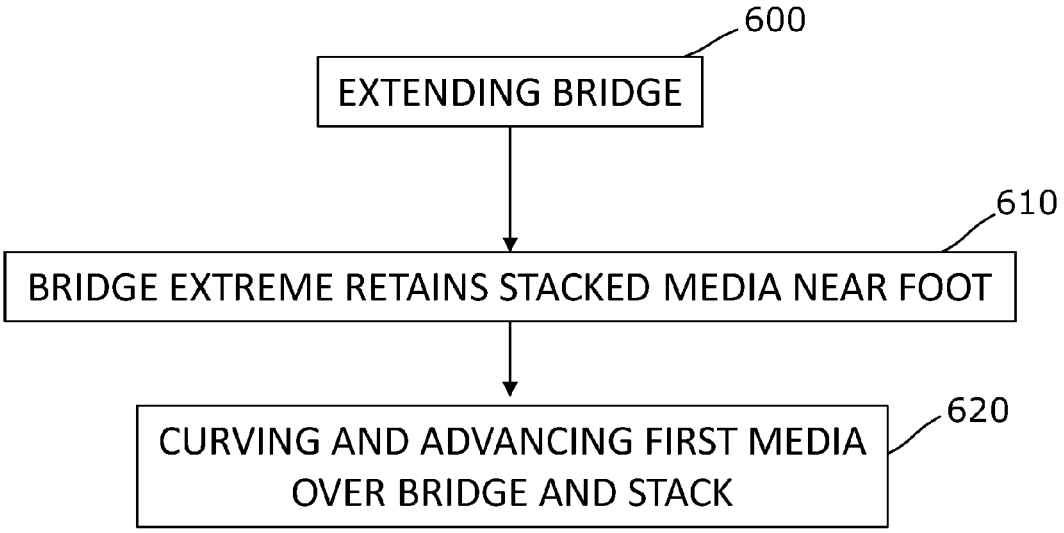
FIG. 10 illustrates a flow chart of a further example method of printing.

FIG. 10 illustrates a flow chart of a further example of a method of printing large format media 3, 103. For example the method of FIG. 10 chronologically follows after the method of FIG. 9. For example the method of FIG. 10 includes extending the bridge 131, 231 (block 600). For example the method includes an extreme 131B, 231B of the bridge 131, 231 retaining stacked media near a foot 103B of the stacked media (block 610), by said extending. For example, the method includes curving and advancing the first media 3, 103 over the bridge 131, 231 and over the retained media stack (block 620).

Figure 11:
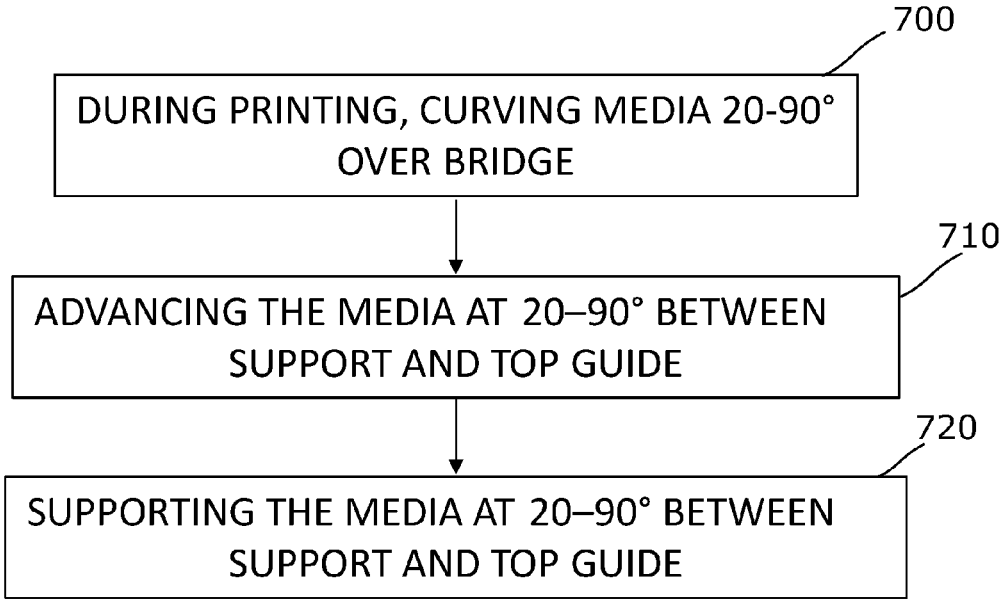
FIG. 11 illustrates a flow chart of another example method of printing.

FIG. 11 illustrates a flow chart of another example of a method of printing. For example the method of FIG. 11 can be applied in conjunction with the method of FIG. 9 and/or 10. For example the method of FIG. 11 includes curving the first media 3, 103 over an angle $\alpha$ of between 20 and 90 degrees, or for example between approximately 20 and 85 degrees, or for example between approximately 70 and 80 degrees, or for example close to 75 degrees, so that the printed image faces towards a front side 14 of the printer 1 (block 700), for example in a direction B, Bh towards an operator 15. For example the image facing direction B has a horizontal component Bh and in a further example the image facing direction B also has a vertical component Bv. For example, the method includes advancing the first media 3, 103 between a support 12, 112, 212 at the back of the first media 3, 103 and a top guide 13, 113, 213 at the image side 16 of the first media 3, 103 under said angle $\alpha$ of between 20 and 90 degrees (block 710), or for example between approximately 20 and 85 degrees, or for example between approximately 70 and 80 degrees, for example close to 75 degrees. For example, the method includes supporting the first media 3, 103 between a support 12, 112, 212 at the back of the first media 3, 103 and a top guide 13, 113, 213 at the image side 16 of the first media 3, 103 under said angle $\alpha$ of between 20 and 90 degrees (block 720), or for example between approximately 20 and 85 degrees, or for example between approximately 70 and 80 degrees, for example close to 75 degrees.

In further examples the printer includes a media roll input for connecting a media roll for printing on the media roll. In further examples the printer includes a media cutter for cutting the media, wherein the media cutter can be arranged downstream of the printhead and upstream of the stacker. In again further examples, the printer includes a radiation device for example for curing the ink, for example to radiate heat and/or UV, and/or for blowing air. For example the radiation device is arranged downstream of the printhead, for example connected to the printhead, and upstream of the stacker. The radiation device can aid accelerating an ink drying process of the printed image before stacking.

In an example the stacker 10, 110, 210 of this disclosure provides for a relatively compact in line stacking solution for a large format printer. For example, the stacker 10, 110, 210 can be readily integrated with the printer 1 for stacking the media face forward while printing, and while adding little or no extra foot print as compared to a similar printer without stacker. Furthermore some of the example stackers 10, 110, 210 are relatively cost efficient, of relatively simple construction, and/or composed of a relatively low amount of materials and components. For example, the stacker 10, 110, 210 allows for stacking a relatively wide range of media thicknesses. For example an operator standing at the front 14 of the printer can view and take out the media from the stacker 10, 110, 210 without moving the printer and without moving to the back of the printer.

The above description is not intended to be exhaustive or to limit this disclosure to the examples disclosed. Other variations to the disclosed examples can be understood and effected by those of ordinary skill in the art from a study of the drawings, the disclosure, and the claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of this disclosure.

The invention claimed is:

1. A print media stacker, comprising:

a ramp to curve printed media over an angle of between about 20 and 90 degrees relative to a media advance direction in a print zone;

downstream of the ramp, a support to support a media stack to be inclined over the angle;

a stack foot support located at a bottom of the support, the stack foot support to support bottom edges of the media stack;

a bridge extending over at least a portion of the stack foot support to guide media into the support; and a top guide opposite the support, the top guide spanning approximately a full width of the support, the top guide to guide the media on an image side of the media.

2. The stacker of claim 1, wherein the bridge is a retractable bridge, the bridge to guide the media into the support when the bridge is in an extended position, the bridge to release the media into the stack foot support when the bridge is in a retracted position.

3. The stacker of claim 2, wherein, in the extended position, an extreme of the bridge is to retain the media stack while guiding the media being printed.

4. The stacker of claim 1, wherein the bridge is part of the ramp.

5. The stacker of claim 4, wherein the bridge is located downstream of a first ramp portion.

6. The stacker of claim 1, further including retractable pinch wheels to:

in an extended position, advance the media over the bridge by pinching the media relative to the bridge; and in a retracted position, release the media.

7. The stacker of claim 1, wherein the top guide includes regularly distributed guides arranged in a plane approximately parallel to the media support, the guides to engage the media on the media support.

8. The stacker of claim 7, wherein the guides include rollers or passive wheels.

9. The stacker of claim 1, wherein the top guide defines openings to view a printed image through the top guide.

10. The stacker of claim 1, wherein the top guide includes a first hinge to hinge the top guide relative to the support.

11. The stacker of claim 10, wherein the top guide including a base portion, an upper portion, and a second hinge, the second hinge to hinge the upper portion relative to the base portion.

12. The stacker of claim 1, wherein the support includes a curved upper portion to curve the media over an upper portion of a stacker.

13. The stacker of claim 1, further including, downstream of the bridge, a stacker input drive to advance media into the support.

14. The stacker of claim 1, further including a large format media stacker having a width of at least approximately 59 centimeters.

15. A large format printer, including the stacker of claim 1.

16. A method of printing media using the stacker of claim 1, the method including:

printing the media;

during the printing, advancing the media over the bridge into a stacker;

retracting the bridge when a trailing edge of the media has passed the bridge; and releasing a foot of the media into the stack foot support below the bridge.

17. The method of claim 16, further including:

extending the bridge;

an extreme of the bridge retaining the stacked media near the foot when extended; and curving and advancing the media over the bridge and over the retained media stack.

* * * * *